US007490450B2

(12) United States Patent
Stahlecker

(10) Patent No.: US 7,490,450 B2
(45) Date of Patent: Feb. 17, 2009

(54) PROCESS AND ARRANGEMENT FOR COVERING A FLAT BLANK WITH A COVER

(75) Inventor: Werner Stahlecker, Goeppingen (DE)

(73) Assignee: Michael Hoerauf Maschinenfabrik GmbH & Co. KG, Donzdorf (DE)

( * ) Notice: Subject to any disclaimer, the term of this patent is extended or adjusted under 35 U.S.C. 154(b) by 22 days.

(21) Appl. No.: 11/583,390

(22) Filed: Oct. 18, 2006

(65) Prior Publication Data

US 2007/0093371 A1 Apr. 26, 2007

(30) Foreign Application Priority Data

Oct. 24, 2005 (DE) ..... 10 2005 051 477

(51) Int. Cl.
*B65B 11/48* (2006.01)

(52) U.S. Cl. ..... 53/206; 493/328; 493/334; 412/17; 412/19

(58) Field of Classification Search ..... 493/328, 493/334; 53/411, 206, 214; 270/52.01, 52.18, 270/58.01, 58.05, 58.23; 412/3, 5, 17, 19, 412/21–24

See application file for complete search history.

(56) References Cited

U.S. PATENT DOCUMENTS 2,667,909 A * 2/1954 Stobb ..... 156/444
2,808,099 A * 10/1957 Silverman ..... 156/479
3,922,743 A * 12/1975 Schuler et al. ..... 412/1
5,409,341 A * 4/1995 Rathert ..... 412/17
5,413,446 A * 5/1995 Rathert et al. ..... 412/17
6,669,429 B2 * 12/2003 Beermann et al. ..... 412/19
6,769,676 B2 * 8/2004 Machon et al. ..... 270/58.23
6,843,473 B2 * 1/2005 Bohn et al. ..... 270/52.18
2005/0180843 A1 * 8/2005 Porat ..... 412/19

OTHER PUBLICATIONS

Michael Hoerauf Maschinenfabrik GmbH & Co. KG, "BDM Speed High Quality Casemaker" brochure (6 pages).

* cited by examiner

*Primary Examiner*—Hemant M Desai
(74) *Attorney, Agent, or Firm*—Flynn, Thiel, Boutell & Tanis, P.C.

(57) ABSTRACT

A process and an arrangement for covering a flat-lying blank, preferably made of cardboard with a cover, in particular applicable in the production of book covers is described. The covering takes place in cycles in a number of working stations, whereby an overall cycle time can be given to each working station in advance. Each working station comprises at least one working means, to which at least one sub-cycle time is assigned. It is provided that in the case of a constant remaining overall cycle time, at least one sub-cycle time assigned to the working means of a procedural step is adapted to the processed materials. The present invention is in particular applicable when at least one edge of a cover applied to a blank is folded over. The folding over of the edge takes place thereby in a folding station within the pre-set overall cycle time. Within one cycle, at least the following procedural steps are carried out: "transport", in which the blank with the cover is transported into the folding station, "preparing", in which at least one folding means is placed to the edge of the cover, and "folding and pressing", in which the folding means folds over the edge of the cover and presses it onto the blank. It can in particular be provided that the ratio of the sub-cycle time "folding and pressing", assigned to the folding means to the overall cycle time is variable.

10 Claims, 1 Drawing Sheet

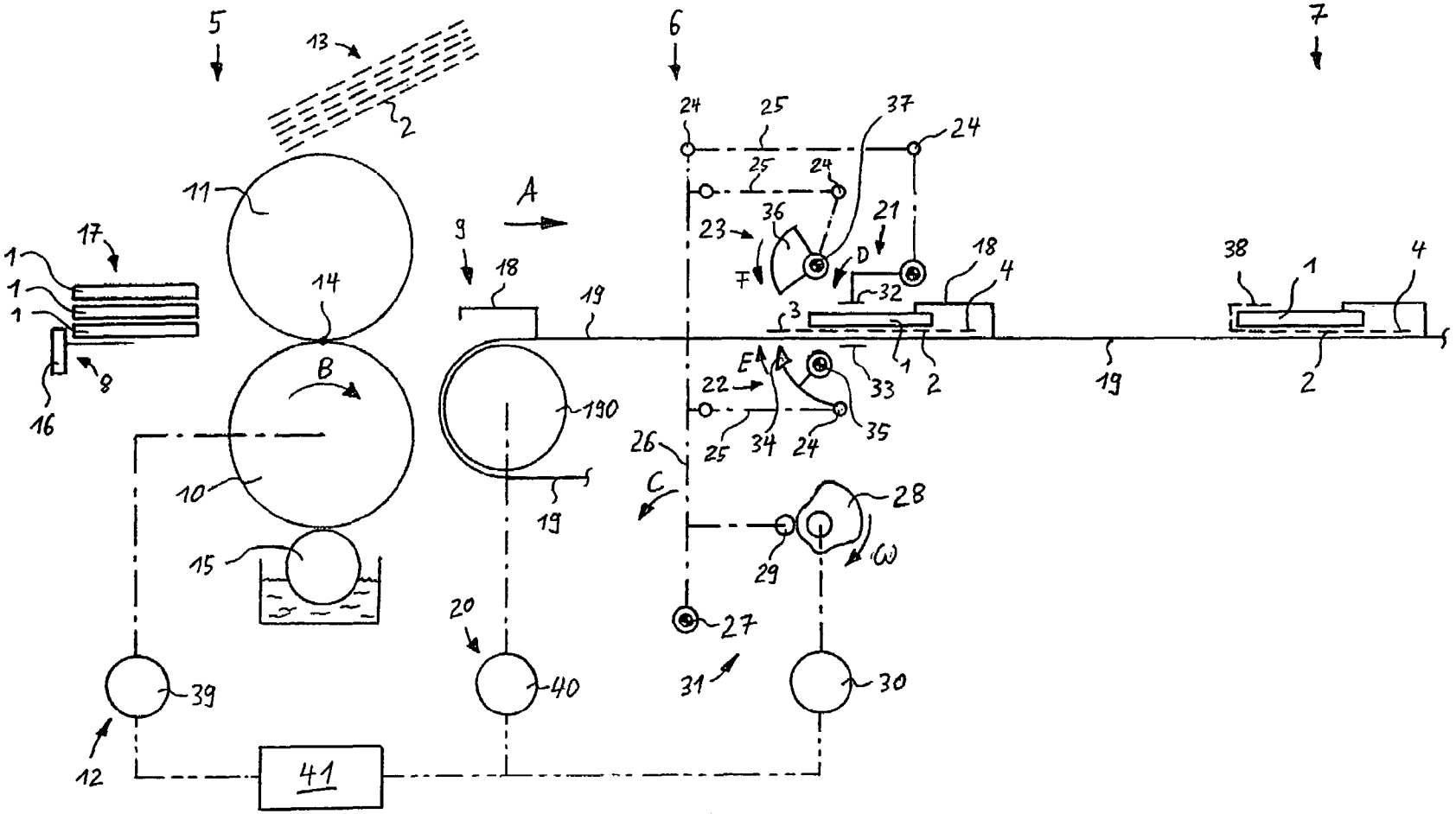
A
B
C
D
E
F
ω
1
2
3
4
5
6
7
8
9
10
11
12
13
14
15
16
17
18
19
20
21
22
23
24
25
26
27
28
29
30
31
32
33
34
35
36
37
38
39
40
41

PROCESS AND ARRANGEMENT FOR COVERING A FLAT BLANK WITH A COVER

BACKGROUND AND SUMMARY OF THE INVENTION

The present invention relates to a process for covering a flat-lying blank, preferably made of cardboard with a cover, which are in particular applicable in the production of book covers, in which the covering takes place in cycles in a number of working stations, and in which each working station carries out a number of procedural steps within a predetermined overall cycle time.

The present invention relates further to an arrangement for covering a flat-lying blank, preferably of cardboard with a cover, in particular for the production of a book cover, comprising at least one working station, whereby a predetermined overall cycle time is assigned to each working station, and whereby each working station comprises at least one working means, to which at least one sub-cycle time is assigned.

A process and an arrangement of this type are prior art arising out of the manufacture and sale of book cover machines of the type "BDM Speed" by Hoerauf. A book cover machine of this kind operates with a changeable number of cycles per minute, whereby the blank is transported in cycles through a number of working stations of the machine and provided with the cover. The manufacturing process includes hereby at least the cycles "joining", "front and rear folding", "lateral folding" and "pressing". If for example, the machine operates at 60 cycles a minute, the overall cycle time of one cycle amounts to exactly one second. Within this overall cycle time, a number of procedural steps have to be carried out, whereby in addition to the actual work steps in the stations, the transport into the station must also be carried out within this overall cycle time. During the first cycle "joining", for example, the cover and the blank are transported into the first station, the cover is coated with glue and brought together with the blank. In a subsequent cycle the blank with the cover is transported into a folding station, the edge of the cover is prepared and finally folded and pressed onto the blank. Each of these procedural steps within the overall cycle time of a cycle is assigned a sub-cycle time. The drive and control concept of the machine enables the procedural steps of one cycle to be carried out always in the same ratio to the overall cycle time, in spite of the variable cycle rate of the machine. This means for the folding station that in designing the machine, when once a sub-cycle time "folding and pressing" is assigned to the folding means amounting to a quarter of the overall cycle time, then this ratio of the sub-cycle time to the overall cycle times could no longer be changed. In the case of an increase in the cycle rate of the machine, that is, an increase in the production speed, the overall cycle time for each individual cycle is reduced. In accordance with the once predetermined ratio of the respective sub-cycle time to the overall cycle time, the sub-cycle time for each procedural step in a station is also reduced.

The known machine has hereby the disadvantage that the duration of the procedural steps which determine the quality of the finished book cover, and the sub-cycle time of the corresponding work means are only changeable by means of a change in the overall cycle time, that is, in the cycle rate and the production speed. Materials which are difficult to process, for example particular glue types or cover materials having a high degree of stiffness can only be processed at low cycle rates and reduced production speed, as these materials require relatively long sub-cycle times for application of the glue and for the procedural step "folding and pressing" in order to be processed properly.

It is an object of the present invention to improve a process of the above named type with regard to its adaptability to various properties of the material to be processed, and to increase the flexibility of an arrangement of the above mentioned type.

This object has been achieved in accordance with the present invention in that in the process, at least a sub-cycle time of a procedural step is adapted to the material to be processed while the overall cycle time remains constant. In the case of the arrangement, the object has been achieved in that the ratio of the sub-cycle time assigned to the working means is variable in relation to the overall cycle time.

An embodiment of this type has the advantage in that in each working station the duration of the quality-determining procedural steps can be adapted to the requirements of the material to be processed, without changing the production speed. In the joining station, for example, it is possible to reduce the speed of the cover when the glue is being applied, when a highly viscous glue or a glue which may spray drops of glue during application, is processed. As at the beginning of each cycle the blank is transferred from the foregoing working station, each station has for its procedural steps only the duration of the predetermined overall cycle time at its disposal. This ensures a fault-free interaction of all the successive working stations with one another. Within the overall cycle time of a cycle it is however advantageous to design the speeds of the individual work means to be variable, so that in particular the quality-determining procedural steps are assigned an optimal portion of the cycle time. This is then particularly simple when in each working station a drive for the respective working means is provided and this drive comprises at least one motor driveable at a non-uniform angular velocity. Motors connected to a control system for varying the ratio of the sub-cycle time assigned to the working means in relation to the overall cycle time are particularly advantageous.

In particular when an edge of a cover applied to a blank is folded over, an embodiment of this kind has the advantage in that the duration of the quality-determining procedural step "folding and pressing" can be set without altering the speed of production. At a constant remaining cycle rate of the machine, the sub-cycle "folding and pressing" can be chosen in such a way that the cover to be processed is optimally folded over.

Particularly advantageous is when at a constant remaining overall cycle time the duration of the procedural step "folding and pressing" is extended and the duration of the procedural step "preparing" is shortened. This permits the reliable processing, with relatively high cycle rates and production speeds, of difficult cover materials, for example material with a high degree of stiffness. As a result of the extended pressing-on time, the glue has more time to adhere, thus preventing the folded edge from separating from the blank again, even in the case of thicker or stiffer covers. In the case of this arrangement, while maintaining a constant overall cycle time, the sub-cycle time "folding and pressing" assigned to the folding means is extendable while the sub-cycle time "preparing" assigned to the folding means can be reduced.

Even more scope for adjustment and an even higher variability for the procedural step "folding and pressing" can be achieved in that, at a constant remaining overall cycle time, the duration of the procedural step "folding and pressing" is extended and the duration of the procedural step "transport", in which the blank provided with the cover is transported into the folding station, is shortened. In this arrangement this is achieved in that, at a constant remaining overall cycle time, the sub-cycle time "folding and pressing" assigned to the folding means is extendable and the sub-cycle time "transport" assigned to the transport means can be reduced.

In a further advantageous embodiment of the arrangement according to the present invention it is provided that the drives are connected with a control system for varying the ratios of the sub-cycle time "folding and pressing" to the overall cycle time. A variation of the above mentioned ratio can be very simply carried out by the operating personnel, for example, on a computer monitor.

In order to achieve a high variability and an easy adjustment it can be provided that all folding and transporting means are driven by their own drive motor which is connected to the control system. This embodiment has, however, the disadvantage in that a very large number of single motors would have to be provided when a number of folding means are provided.

For this reason, cam plates for driving the folding means are applied in the book cover machine described above as prior art. The cam plates for the various folding means of a folding station are located in the form of a cam plate packet on a joint drive shaft and are driven by a motor having uniform angular velocity. The angular velocity of the cam plates is chosen according to the cycle rate of the machine in such a way that each cam plate rotates once around its axis during the length of one overall cycle time. Because of the cam plates, driven at a uniform velocity, the known machine has the disadvantage described above, that the ratio of the sub-cycle time assigned to the folding means to the overall cycle time is constant and cannot be changed. The ratios of the sub-cycle times to the overall cycle time is set by the geometry of the cam plates and cannot be changed once the machine is in operation.

It is therefore advantageous that the drive of the folding means comprises at least one cam plate driveable at a non-uniform angular velocity. This permits the sub-cycle time "preparing" assigned to the folding means to be shortened, in that the angular velocity of the cam plate in this area is increased and the sub-cycle time "folding and pressing" assigned to the folding means to be extended, in that the cam plate in this area is driven with reduced angular velocity. Overall, however, it is provided that the cam plate rotates once around its axis during one overall cycle time. The amount of required overall time for the folding process does not change because of this, so that the interaction of the working stations upstream and downstream continues to be ensured.

In a further embodiment of the present invention it can be provided that the folding means for "folding and pressing" consists of a brush. The folding of the edge can be carried out in a process of particularly high quality and without creasing. In addition it can be advantageous when the folding means for "folding and pressing" is separated from the folding means for "preparing". In order to prevent the cover coming off the blank when the edge is being folded, it can be advantageous to assign at least one clamping device for the blank provided with the cover to the folding means for "preparing".

DESCRIPTION OF THE DRAWING

These and further objects, features and advantages of the present invention will become more readily apparent from the following detailed description thereof when taken in conjunction with the accompanying drawing.

In the FIGURE a side view is shown of an arrangement according to the present invention in a very schematic way which is not to scale. The shown arrangement serves to produce book covers, folders, ring binders and game boards, in which a flat-lying blank 1 is provided with a cover 2. The blank 1 is normally made of cardboard and can be designed as a one-piece or multi-piece blank 1. The arrangement covers the blanks 1 with covers 2 and folds over the projecting edges 3, 4 of the covers 2. The arrangement comprises a number of working stations 5, 6, 7 having working means and transport means 8, 9, which carry out the necessary procedural steps at a pre-determined cycle rate. In the first work cycle the cover 2 is joined together with a blank 1 fed thereto in a joining station 5. In a subsequent working cycle, the blank 1 provided with the cover 2 is taken over by the transport means 9 and transported in transport direction A to a folding station 6. In the folding station 6 at least one projecting edge 3 of the cover 2 is folded over, that is the cover is folded around the edge of the blank 1. In a further working cycle, the blank 1 is transported by the transport means 9 to a second folding station 7 in which further edges 4 of the cover 2 are folded over. In a way not shown, the blank 1 can be transported by the transport means 9 to further working stations, which could, for example contain a press roller pair for the concluding pressing of the cover 2 to the blank 1. In a variation to the shown working stations 5, 6, 7, it can alternatively be provided that between the joining station 5 and the folding station 6 an empty station, or a station for optional additional devices is located. Furthermore it can be provided that in the first folding station 6 both edges 3 and 4 of the cover 2 are folded simultaneously, and in the second folding station 7 the lateral edges of the cover 2 which also project out and which are not identifiable in the drawing, are folded over.

The joining station 5 comprises a roller pair 10, 11 as a working means, whereby the roller 10 is driven by a drive 12 at uniform speed in rotational direction B. A cover 2 is fed from a batch of covers 13 to the roller 11 and is transferred by the roller 11 at the clamping line 14 of the roller pair 10, 11 to the roller 10. The cover 2 hereby rotates once with the roller 10 and is guided past a gluing roller 15 and covered with glue on its entire surface. When the cover 2 runs into the clamping line 14 again, a blank 1 from a batch of blanks 17 is also fed to the clamping line 14 by the transport means 8 preferably in the form of a slide feed 16. In the clamping line 14, the blank 1 and the cover 2 are brought together and joined to one another. Because of the size and the correspondingly high mass of the rollers 10 and 11, it is advantageous in many applications to keep their speed constant and not to vary it.

The transport means 9 subsequently takes up the blank 1 provided with a cover 2 and exiting out of the clamping line 14 and guides said blank 1 in transport direction A to the folding station 6. The transport means 9 can be designed as belts 19 having grippers 18, said belt 19 being guided over deflecting rollers 190. The gripper 18, at a standstill at the beginning of this working cycle, is accelerated by the drive 20 assigned to the deflecting roller 190, until said gripper 18 has the same speed in transport direction A as the blank 1 exiting out of the clamping line 14. When the synchronous speed is reached the gripper 18 is closed and the blank 1 comprising the cover 2 is taken over by the transport means 9. The transport means 9 and the gripper 18 are stopped when it reaches the folding station 6, and the folding process begins. The embodiment of the transport means 9 with a belt 19 running through a number of working stations 6, 7 has the advantage that the blank 1 can be held in the same gripper 18 and requires no transfer to any other grippers 18. It can, however, be advantageous to design the transport means 9 in a different way.

As working means in the folding station 6 a clamping device 21 and a number of folding means 22 and 23 are provided, which are movable and driveable via coupling links 25 connected by joints 24 by means of one of more swivel levers 26. Each swivel lever 26 is supported at a pivotal point 27 in a rotatable manner and comprises a roller 29 assigned to a cam plate 28. The cam plate 28 is connected to a motor 30, which drives the cam plate 28 at an angular velocity ω. When the cam plate 28 rotates, the differing radius of the cam plate 28 effects a varyingly wide swiveling out of the swivel lever 26 in swivel direction C, which in turn effects a movement of the clamping device 21 and the folding means 22, 23 via the coupling links 25. The cam plate 28 driven by the motor 30, the swivel lever 26 with the roller 29, and the coupling links 25 with the joints 24 form the drive 31 for the clamping device 21 and the folding means 22, 23. For graphic reasons, the drive 31 is shown in greatly simplified detail. A number of swivel levers 26 and a number of cam plates 28 can, of course, be provided so that all necessary movements of the folding station 6 are carried out optimally. Advantageously, all cam plates 28 are arranged on one joint shaft driveable by the motor 30 as a cam plate packet.

When the blank 1 provided with the cover 2 comes to a standstill in the folding station 6, the clamping device 21 is first closed, in that a clamping element 32 moves towards the blank 1 provided with the cover 2 in swivel direction D and is pressed against a second clamping 33 element or against the belt 19. Alternatively it can be provided that the second clamping element 33 is also arranged in a movable way. The blank 1 and the cover 2 are ensured against shifting by means of the closed clamping device 21.

In the procedural step "preparing", the folding means 22 is now placed to the edge 3 of the cover 2 projecting out over the blank 1. The folding means 22 is driven again via the coupling links 25 and the swivel lever 26 by the cam plate 28 and folds the edge 3 of the cover 2 upwards by means of a swivel movement E of a comb-like guide rail around a pivotal point 35. The pre-folded edge 3 of the cover 2 folded by the folding means 22 is subsequently completely folded by the folding means 23 and pressed to the blank 1. Advantageously a flexible brush 36 serves to fold and press, which brush 36 makes a rotational movement F around a pivotal point 37. The brush 36 can hereby be driven via coupling links 25, swivel lever 26 and cam plate 28. The brush 36 can also be driven by a separate motor in a way not shown.

The working cycle of the folding of the edge 3 is now completed. In the subsequent working cycle, the gripper 18 affixed to the belt of the transport means 9 is again accelerated and the blank 1 with the now folded edge 38 of the cover 2 is transported into the second folding station 7. In the folding station 7 the folding of the edge 4 of the cover 2 can take place analog to the folding station 6. A repeat description is therefore omitted. Simultaneously to the transport of the blank 7 with the folded edge 38 from the folding station 6 into the folding station 7, a new blank 1 provided with a cover 2 is transferred from the roller pair 10, 11 to the transport means 9 and fed to the folding station 6.

Each working station 5, 6 and 7 has at its disposal for its respective function the duration of exactly one overall cycle time, which arises from the predetermined cycle rate. If the arrangement operates at, for example, 60 cycles a minute, this means that per minute sixty blanks 1 are fed to the roller pair 10, 11 and also that sixty times a minute an edge 3 of the cover 2 is folded in the folding station 6. At the end of the machine, sixty finished book covers or similar are dispensed, that is, sixty cycles per minute correspond to a production speed of sixty book covers per minute. At a rate of sixty cycles per minute, each working station has an overall cycle time of one second at its disposal. In the folding station 6, the overall cycle time is divided into a sub-cycle time "transport" of the transport means 9, a sub-cycle time "preparing" of the clamping device 21 and the folding means 22 and a sub-cycle time "folding and pressing" of the folding means 23.

In the known arrangement of this type, the ratio of the sub-cycle time "folding and pressing" assigned to the folding means 23 to the overall cycle time was always constant. This lay in the fact that all cam plates 28 provided for the clamping device 21, the folding means 22 and the folding means 23 were affixed on a joint drive shaft of the motor 30 and always driven by same at a constant angular velocity ω. In a variation of the cycle rate or the overall cycle time of the arrangement, the angular velocity ω could be adapted in a such a way that one rotation of the cam plate 28 could take place within the overall cycle time, while the angular velocity remained nevertheless uniform.

The duration of the sub-cycle "folding and pressing", depending on the properties of the cover 2, is decisive for the quality of the folded edge 38. If the sub-cycle "folding and pressing" of the folding means 23 is too short in relation to the degree of stiffness of the cover 2, the glue between the cover 2 and the blank 1 does not set sufficiently, so that the stiffness of the cover 2 results in the folded edge 38 coming off again. The known arrangement has hereby the disadvantage that, because of the cam plates 28 driven at uniform angular speed ω, the sub-cycle time "folding and pressing" could not be altered independently of the overall cycle time. In the case of difficult cover materials having a high degree of stiffness, only the overall cycle time could be reduced in order to extend the sub-cycle time "folding and pressing", whereby reduction in production speed must be reckoned with.

This disadvantage is avoided in the case of the present invention in that the sub-cycle time "folding and pressing" assigned to the folding means 23 is variable independently of the overall cycle time. As essentially only the procedural step "folding and pressing" is a deciding factor for the quality of the folded edge 38, it is now possible to choose its sub-cycle time in the case of a given overall cycle time arising out of the desired production speed in such a way that the relevant material is processed well. In accordance with an extension of the sub-cycle time "folding and pressing", the sub-cycle times for the procedural steps "preparing" and "transport", which are not critical for the quality of the folded edge 38, can be shortened. During the sub-cycle time "preparing", the clamping device 21 is closed, the folding means 22 with the comb-like guiding rail 24 is moved upwards in order to place the edge 3 of the cover 2 upright. Limiting factors for the shortening of the sub-cycle time "preparing" occur only due to inertia forces arising from acceleration, which can be minimized by the application of modern materials such as carbon fibre reinforced composites.

In the case of the shown drive concept of the drive 31 for the folding means 22 and 23 it is advantageous that at least one cam plate 28 is driveable at non-uniform angular velocity. The motor 30 of the drive 31 is hereby advantageously designed as a servo motor and connected to a control system 41 together with the motors 39 and 40 of the drives 12 and 20. A variation of the ratio of the sub-cycle time "folding and pressing" to the overall cycle time can thus very easily carried out via the control system 41.

As the brush of the folding means 23 must only carry out one rotational movement F around the axis of rotation 37, it can be advantageous instead of the shown drive 31 via a cam plate 28 to apply a separate motor connected to the control system 41. It should be expressly pointed out that the embodiment of the folding means 22 and 23 as a comb-like guiding rail 34 and brush 36 is simply one variation of an embodiment. The folding means 22 and 23 can just as well be designed as folding rails or similar.

As the extension of the sub-cycle "folding and pressing" by means of the correspondingly necessary shortening of the sub-cycle "preparing" is at some point set limits, it can be advantageous to also shorten the sub-cycle time of the procedural step "transport", in which the blank 1 provided with the cover 2 is transported into the folding station 6. A shortening of the sub-cycle time "transport" permits a further extension of the sub-cycle time "folding and pressing". As the take-up of the blank 1 provided with the cover 2 by the roller pair 10, 11 of the joining station 5 must take place at synchronous speed, a shortening of the sub-cycle time "transport" can advantageously take place in that the blank 1 provided with the cover 2 is accelerated by the transport means 9 beyond the synchronous speed of the roller pairs 10, 11, as soon as the end of the cover 2 is released by the clamping line 14 of the roller pair 10, 11. A particularly great shortening of the sub-cycle time "transport" can be achieved in those cases in which the length of the blank 1 in comparison to the transport distance from the joining station 5 to the folding station 6 is short, as then the distance which the gripper 18 must cover with the synchronous speed to the roller pair 10, 11 is also short.

In an embodiment of the present invention it can be provided that the roller 10 as a working means of the joining station 5 is driven at non-uniform speed in rotational direction B. In the case of the described concept of the feeding of the cover 2 from a batch of covers 13 above the roller 11 it is provided that the roller 10 rotates exactly twice around its axis during one overall cycle time. By means of a motor 39, driveable at non-uniform angular velocity in the drive 12 of the joining station 5, and its connection with the control system 41, the roller 10 can be so driven that it executes the two rotations during the overall sub-cycle time also at non-uniform speed in rotational direction B. It can be hereby in turn be advantageous to shorten a sub-cycle time "transport", in which the cover 2 is fed via the roller 11 and the roller 10 to the gluing roller 15, in that the angular velocity of the motor 39 during this sub-cycle time is increased. The sub-cycle time "glue application", in which the cover 2 is guided past the gluing roller 15, and in which the glue is applied to the cover 2, and/or the sub-cycle "joining", in which the glued cover 2 is joined in the clamping line 14 together with blank 1, can be extended correspondingly by means of a lowering of the angular velocity of the motor 39, without the overall cycle time changing for the two rotations of the roller 10. This case also permits an adaptation of the sub-cycle times to the properties of the materials to be processed.

In the case of the above mentioned known book cover machine "BDM Speed" from the firm Hoerauf, the sub-cycle time "folding and pressing" takes 250 ms (milliseconds) in an overall cycle time of one second, that is, at a cycle rate of 60 cycles per minute, which is not sufficient for materials difficult to process. At the same cycle rate and unchanged overall cycle time of one second, the sub-cycle time "folding and pressing" can be extended by up to 15 ms due to the shortening of the sub-cyle time "transport" according to the present invention. By means of the drive 31 of the folding means 22 and 23 at non-uniform angular velocity ω, the sub-cycle time "folding and pressing" can—at a constant remaining overall cycle time of one second—be extended by up to 50 ms. Because of the possible extension of the duration of the procedural step "folding and pressing" from 250 ms to 315 ms at a constant remaining overall cycle time of one second, the application area and the variability of the material to be processed for the cover 2 can be greatly increased without a loss in productivity.

The invention claimed is:

1. An arrangement for covering a flat-lying blank preferably made of cardboard with a cover, in particular in the production of book covers, comprising at least one working station, whereby a predetermined overall cycle time is assigned to each working station, and whereby each working station comprises at least one working means, to which at least one sub-cycle time is assigned, wherein the ratio of the sub-cycle time assigned to the working means to the overall cycle time is variable.

2. The arrangement according to claim 1, wherein a drive for the working means comprises at least one motor driveable at a non-uniform velocity.

3. An arrangement for folding at least one edge of a cover applied to a blank within a pre-determined overall cycle time, having at least one folding station, the folding station comprising at least one folding means connected to a drive, and comprising at least one transport means connected to a drive, whereby at least a preparing sub-cycle time and a folding and pressing sub-cycle time are assigned to the folding means, and whereby a transport sub-cycle time is assigned to the transport means, wherein the ratio of the folding and pressing sub-cycle time to the overall cycle time is variable.

4. The arrangement according to claim 3, wherein at a constant remaining overall cycle time the folding and pressing sub-cycle time is extendable and the preparing sub-cycle time can be shortened.

5. The arrangement according to claim 3, wherein at a constant remaining overall cycle time the folding and pressing sub-cycle time is extendable and the transport sub-cycle time can be shortened.

6. The arrangement according to claim 3, wherein the drive is connected to a control system for varying the ratio of the folding and pressing sub-cycle time to the overall cycle time.

7. The arrangement according to claim 3, wherein the drive of the folding means comprises at least one cam plate driveable at a non-uniform angular velocity.

8. The arrangement according to claim 3, wherein the folding means for folding and pressing is a brush.

9. The arrangement according to claim 3, wherein the folding means for folding and pressing is separated from the folding means for preparing.

10. The arrangement according to claim 3, wherein a clamping device for the blank provided with the cover is assigned to the folding means for preparing.

* * * * *